US006915618B2

(12) United States Patent
Payne

(10) Patent No.: US 6,915,618 B2
(45) Date of Patent: Jul. 12, 2005

(54) TOWER MONOPOLE REINFORCEMENT

(75) Inventor: Calvin J. Payne, Blaine, WA (US)

(73) Assignee: SpectraSite Communications, Inc., Cary, NC (US)

( * ) Notice: Subject to any disclaimer, the term of this patent is extended or adjusted under 35 U.S.C. 154(b) by 0 days.

(21) Appl. No.: 10/404,741

(22) Filed: Apr. 1, 2003

(65) Prior Publication Data

US 2004/0194402 A1 Oct. 7, 2004

(51) Int. Cl.[7] ..... E04C 2/30
(52) U.S. Cl. ..... 52/736.1; 52/726.4; 52/731.4
(58) Field of Search ..... 52/40, 170, 496, 52/296, 736.2, 737.1, 726.4, 731.4, 736.1; 343/890, 891

(56) References Cited

U.S. PATENT DOCUMENTS

| | | | | |
|---|---|---|---|---|
| ,658,779 | A | 10/1900 | Huntress | |
| 1,579,285 | A | 4/1926 | Danaher et al. | |
| 2,897,553 | A | 8/1959 | Gorrow | 20/100 |
| 3,959,946 | A | 6/1976 | Holmes et al. | 52/731 |
| 4,228,627 | A | 10/1980 | O'Neill | 52/295 |
| 4,242,851 | A | 1/1981 | Pohlman et al. | 52/743 |
| 4,295,317 | A | 10/1981 | VanTielen | 52/637 |
| 4,405,111 | A | 9/1983 | Lennon | 248/544 |
| 4,406,561 | A | 9/1983 | Ewing | 403/343 |
| 4,503,645 | A | 3/1985 | Nudd et al. | 52/40 |
| 4,687,380 | A | 8/1987 | Meek et al. | 405/204 |
| 4,745,412 | A | 5/1988 | Creaser, Jr. | 343/890 |
| 4,769,967 | A | 9/1988 | Bourrieres | 52/727 |
| 4,878,984 | A | 11/1989 | Bourrieres | 156/431 |
| 4,987,718 | A | 1/1991 | Knight | 52/742 |
| 4,991,367 | A | 2/1991 | McGinnis | 52/170 |
| 5,056,673 | A | 10/1991 | Williams | 212/179 |
| 5,090,165 | A | 2/1992 | Kenny | 52/165 |
| 5,117,607 | A | 6/1992 | Bourdon | 52/731 |

(Continued)

OTHER PUBLICATIONS

CommStructures' Pole*SAVER* System, http://www.commstructures.com/reinforce.html#advantages, printed Feb. 25, 2003, 4 pages.
HG Hollo–Bolt, Lindapter International, www.lindapter-.com; printed approximately Jan., 2003, 3 pages.
DSI Dywidag–Systems International, www.dywidag–systems.com, printed approximately Jan., 2003, 2 pages.
Drawing, SpectraSite, "185' Monopole Reinforcing", Nov. 30, 1999, 1 page.
"CommStructures" Installation Photos taken late 2001, 15 pages.

*Primary Examiner*—Ramon O Ramirez
(74) *Attorney, Agent, or Firm*—Nelson Mullins Riley & Scarborough LLP

(57) ABSTRACT

Reinforcing apparatus for tower monopoles. The reinforcing apparatus comprises vertical threaded reinforcing bar rods, or rods with threaded ends, arranged around the pole and embedded in the pole foundation. The rods extend upward and are attached to the pole at spaced intervals using brackets. There are means provided for attaching rod segments to the pole at vertically spaced intervals, such as brackets. The rods comprise distinct rod segments, and means are provided for joining the vertically adjacent rod segments are provided, such as threaded couplings.

Brackets include anchor bolts that fasten the bracket to the pole and U-shape bolts fastened to the bracket to hold the rod segments to the bracket. The curved portions of the U-bolts are aligned in the grooves of the threaded reinforcing bar, preventing relative movement of the bracket and the rod segment. A method is also provided for reinforcing a tower monopole.

23 Claims, 3 Drawing Sheets

U.S. PATENT DOCUMENTS

| | | | | | |
|---|---|---|---|---|---|
| 5,291,709 | A | | 3/1994 | Vranjesevic | 52/297 |
| 5,317,844 | A | | 6/1994 | Legler | 52/155 |
| 5,333,436 | A | | 8/1994 | Noble | 52/726.3 |
| 5,333,824 | A | | 8/1994 | Dubinsky | 248/159 |
| 5,345,732 | A | | 9/1994 | Knight et al. | 52/170 |
| 5,371,986 | A | | 12/1994 | Guditis | 52/170 |
| 5,383,749 | A | | 1/1995 | Reisdorff et al. | 405/232 |
| 5,542,229 | A | | 8/1996 | Saito et al. | 52/721.5 |
| 5,687,537 | A | | 11/1997 | Noble | 52/726.3 |
| 5,855,103 | A | | 1/1999 | Moore | 52/651.02 |
| 5,870,968 | A | | 2/1999 | Dundorf | 116/174 |
| 5,878,540 | A | | 3/1999 | Morstein | 52/296 |
| 5,920,291 | A | * | 7/1999 | Bosley | 343/892 |
| 6,026,627 | A | * | 2/2000 | Moore | 52/651.02 |
| 6,079,165 | A | | 6/2000 | Bingel, III et al. | 52/170 |
| 6,142,434 | A | | 11/2000 | Trost et al. | 248/218.4 |
| 6,167,673 | B1 | | 1/2001 | Fournier | 52/726.4 |
| 6,244,014 | B1 | | 6/2001 | Barmakian | 52/736.3 |
| 6,322,863 | B1 | | 11/2001 | Kubicky | 428/34.5 |
| 6,409,183 | B1 | | 6/2002 | Wemmenhove | 280/11.18 |
| 6,446,411 | B2 | | 9/2002 | Natelli, Jr. | 52/730.1 |
| 6,453,636 | B1 | | 9/2002 | Ritz | 52/736.4 |
| 6,694,698 | B2 | * | 2/2004 | Ryan | 52/741.1 |
| 6,768,474 | B2 | * | 7/2004 | Hunt | 343/892 |
| 2001/0000839 | A1 | | 5/2001 | Ritz | 52/146 |
| 2002/0069596 | A1 | | 6/2002 | Ritz | 52/148 |
| 2002/0170261 | A1 | | 11/2002 | Brunozzi et al. | 52/721.4 |
| 2002/0176951 | A1 | | 11/2002 | Al Zoubi et al. | 428/34.1 |
| 2002/0190914 | A1 | * | 12/2002 | Gillen | 343/890 |
| 2003/0010426 | A1 | | 1/2003 | Lockwood | 156/187 |
| 2003/0026923 | A1 | | 2/2003 | Al Zoubi et al. | 428/34.1 |

* cited by examiner

TOWER MONOPOLE REINFORCEMENT

BACKGROUND OF THE INVENTION

This invention relates generally to an apparatus and method for reinforcing a tower monopole to which loads in excess of the design capacity will be added. More particularly, the invention relates to an apparatus and method that includes the use of vertical rods distributed around a monopole and fixed to the monopole at spaced intervals to increase monopole capacity and stability.

As wireless telecommunications traffic has increased, so has the need for transmission equipment mounted on poles. The transmission equipment needs to be mounted not only on new poles in new geographic areas by individual wireless service providers, but also by competing service providers who install equipment covering overlapping geographic areas. One solution includes purchasing additional land or easements, applying for the necessary government permits and zoning approvals, and constructing a new tower for the new transmission equipment.

Purchasing land or easements, however, can be an expensive undertaking, especially in urban areas where wireless telecommunications demand may be greatest. Zoning regulations often limit the construction of new towers to be in the vicinity of existing towers, or may prohibit the construction of new towers in a service provider's preferred location. The expense and delay associated with the zoning process may be so great that construction of a new tower is not feasible. Further, once zoning regulations are satisfied and permits are obtained, the service provider then incurs the expense associated with the construction and maintenance of a new tower.

The tower itself must be designed to support the weight of the telecommunications transmission equipment as well as the forces exerted on the pole by environmental factors such as wind and ice. The equipment and the environmental factors produce bending moment forces that may cause a single-pole tower, also referred to as a tower monopole, to overturn if not designed for adequate stability. Traditionally, tower monopoles have been designed to withstand only the forces expected from the equipment originally installed on the pole. Rarely are tower monopoles designed with sufficient stability to allow for the addition of new equipment.

Conventional reinforcing methods include the use of split sleeves that fully encircle the tower monopole, extending from an anchor in the foundation upward on the monopole. Such a system uses a significant amount of materials and is cumbersome to install. Other methods require welding of materials to the monopole, which is difficult given the heights at which the welding must be performed.

Thus, there is a need for a method and an apparatus for increasing the capacity and stability of a single-pole tower that will support the loads of additional equipment as well as the corresponding additional environmental forces exerted on the pole.

SUMMARY OF THE INVENTION

The present invention is directed to reinforcing apparatus for tower monopoles, as may be needed when additional loads are placed on an existing pole. The tower monopoles are made up of a metal pole, a concrete foundation, and usually a baseplate at the juncture of the pole with the foundation.

A reinforcing apparatus according to the present invention comprises vertical threaded reinforcing bar rod segments that are partially embedded in the foundation. These rod segments are arranged around the pole and extend upward from the foundation. Similar rod segments are located above and in vertical alignment with the partially embedded rod segments. Means for joining the vertically adjacent rod segments are provided, and may comprise threaded couplings. There are also means for attaching rod segments to the pole at vertically spaced intervals, which may include brackets.

Brackets mounted to the pole include anchor bolts that fasten the bracket to the pole. U-shape bolts are fastened to the bracket and hold the rod segments to the bracket. The curved portions of the U-bolts may be aligned in the grooves of threaded reinforcing bar rod segments, preventing relative movement of the brackets and the rod segments.

Additional rod segments may further be installed above the prior rod segments, and likewise there may be completely embedded rod segments below and joined to the partially embedded rod segments.

In further embodiments, the reinforcing apparatus may comprise substantially vertical base rod segments arranged around the pole, extending upward from proximate to the foundation and having threaded ends, means for attaching the rod segments to the foundation, and means for mounting rod segments to the pole at vertically spaced intervals.

One embodiment includes substantially vertical threaded bar rod segments attached to a pole with brackets comprising U-bolts. The curved portions of the U-bolts are aligned in the grooves of the threaded reinforcing bar rod segments, preventing relative movement of the brackets and the rod segments.

A method is also provided for reinforcing a tower monopole. The steps include coring at least three holes in the foundation spaced around the pole for threaded reinforcing bar rod segments. Mounting devices are installed on the uppermost portion of each lowest rod segment that will remain exposed after being placed in the cored hole, and each lowest rod segment is placed into each respective cored hole. A portion of the lowest rod segments is left partially exposed above the foundation's surface and the void around each lowest rod segment in each respective cored hole is grouted. Mounting devices are installed on a plurality of additional threaded reinforcing bar rod segments and the additional rod segments are joined to each of the exposed ends of the lowest rod segments, using a threaded coupling. Holes are then drilled in the pole for the mounting devices and the mounting devices are attached to the pole.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DETAILED DESCRIPTION OF THE INVENTION

The present invention may be embodied in any application where a metal pole requires additional support beyond that provided by the pole itself. Specific embodiments disclosed herein include the mounting of reinforcing rods having threaded ends, such as threaded steel reinforcing bar, to steel tower monopoles. The scope of the invention is not intended to be limited by the materials or dimensions listed herein, but may be carried out using any materials and dimensions that allow the construction and operation of the present invention. Materials and dimensions depend on the particular application.

In the Figures herein, unique features receive unique numbers, while features that are the same in more than one drawing receive the same numbers throughout. Where a feature is modified between figures or similar features are in different locations, a letter may be added or changed after the feature number to distinguish that feature from the similar feature.

Figure 1:
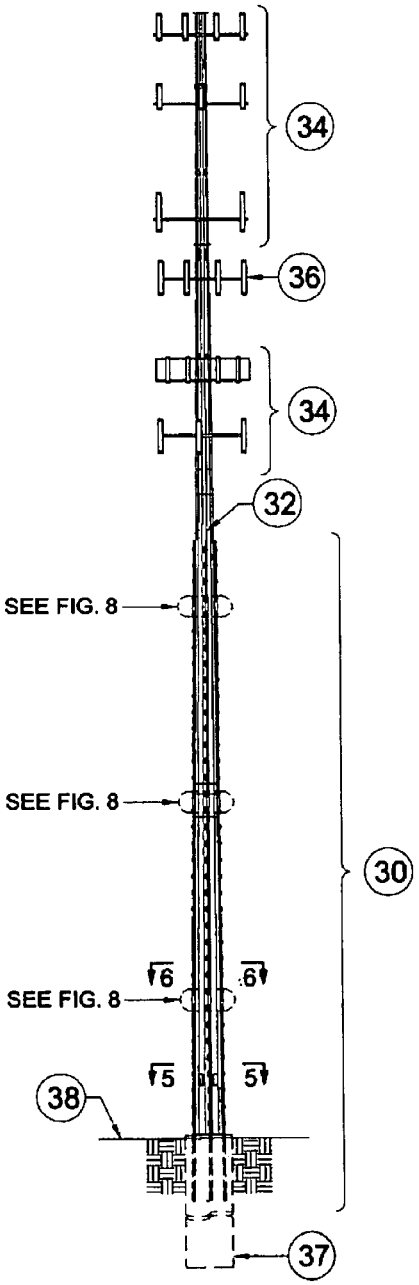
FIG. 1 is an elevation view of one embodiment of the present invention, installed on an existing tower monopole.

Referring now to the drawings, FIG. 1 shows the present invention 30 installed on an existing pole 32. Existing transmission equipment 34, for which the pole was originally designed, is mounted on the pole 32. Additional new transmission equipment 36 is to be added, resulting in additional loads based on its own weight and forces from environmental factors such as wind and ice. An existing foundation 37 is substantially below grade 38.

Figure 2:
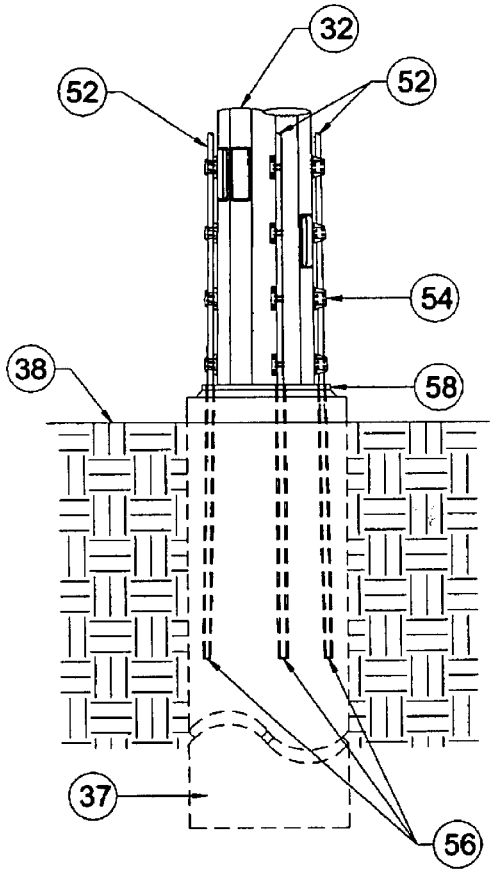
FIG. 2 is a partial elevation view of the embodiment of FIG. 1.

FIG. 2 is an enlarged view showing the foundation 37 and the lowest part of the reinforcing bars 52. In general, two rods are inadequate, but three rods or more may be used. In the embodiment of FIG. 2 there are four separate rods 52 arranged symmetrically around the pole 32; one rod is not visible in FIG. 2. Although the threads are not shown, the reinforcing bars 52 are threaded and are mounted to the pole 32 using spaced mounting devices or brackets 54. The threaded reinforcing bars 52 extend into the foundation 36, being placed in cored holes 56 that are subsequently filled with cementitious grout. The threaded reinforcing bars 52 pass through or around the baseplate 58. The bars 52 are substantially vertical, in that they are installed generally in alignment with the outside surface of the pole 32. The terms "vertical" and "substantially vertical" are used interchangeably herein.

A variety of means for attaching a base rod segments to the foundation are available. For example, the attachment may be made using threaded couplings affixed to plates that are anchored to the foundation, with each affixed threaded coupling in vertical alignment with and attached to each base rod segment. A means for attaching the base rod segments to the foundation may comprise plates mounted to and spaced from the foundation, with each base rod segment passing through a plate and fixed in position with a nut threaded onto the base rod segment on the underside of the plate. Further, the attachment apparatus may comprise plates mounted to and spaced from the foundation, with each base rod segment welded to a plate.

Figure 3:
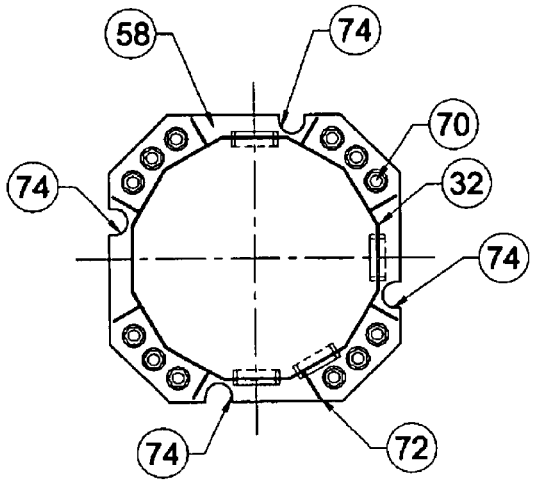
FIG. 3 is a plan view of the baseplate of the embodiment of FIG. 1.
Figure 4:
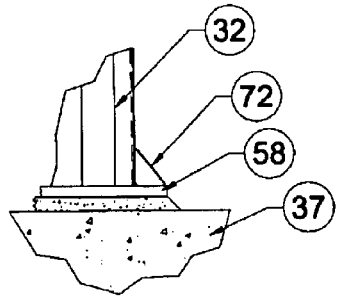
FIG. 4 is an elevation detail view of the baseplate of FIG. 3.

A baseplate 58 is show in FIG. 3, and is an example of an existing baseplate that was installed with the pole as modified to accommodate the present invention. Baseplates are usually present, but in some cases they are omitted. Existing bolts 70 remain in place. Stiffeners 72 are welded between the baseplate 58 and the pole 32; eight stiffeners 72 are used in this embodiment and are detailed in FIG 4. Four holes 74 are torch-cut in the baseplate 58 to allow the holes 56 in the foundation 37 to be cored and the threaded reinforcing bars 52 to pass through. The holes 74 in the baseplate 58 may be cold-gavanized to protect the baseplate from corrosion.

Figure 5:
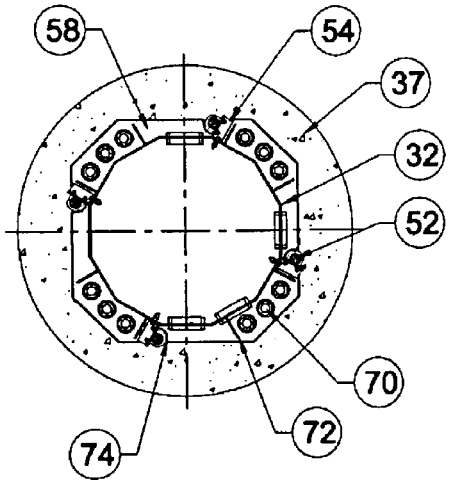
FIG. 5 is a sectional plan view taken along the line 5—5 of FIG. 1.
Figure 6:
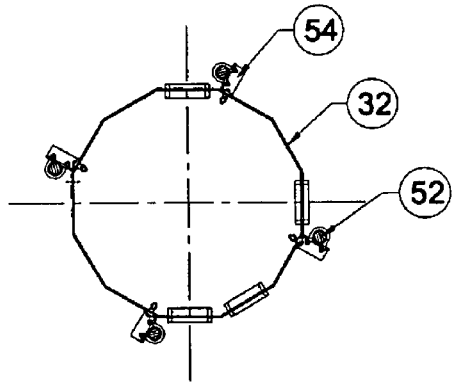
FIG. 6 is a sectional plan view taken along the line 6—6 of FIG. 1.
Figure 7:
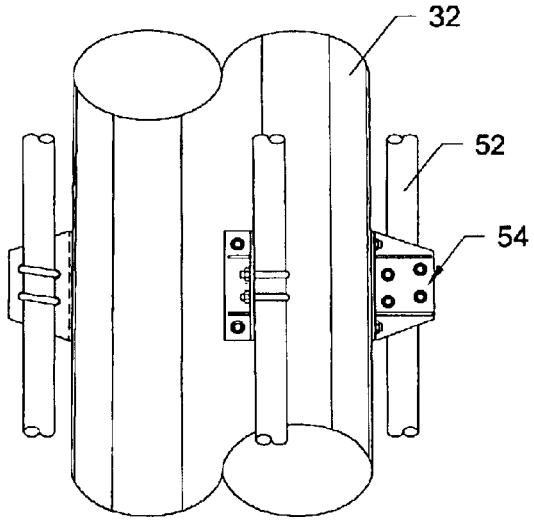
FIG. 7 is a partial elevation view of the mounting of the embodiment of FIG. 1 to the existing tower monopole.
Figure 8:
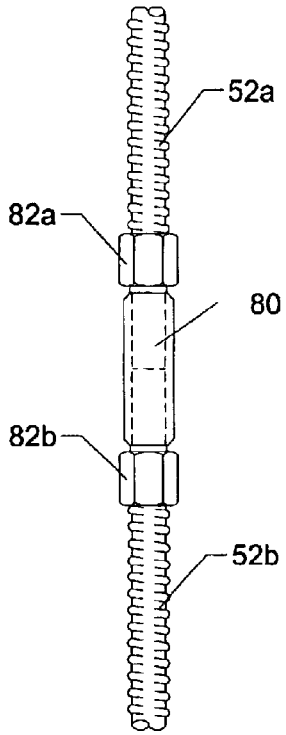
FIG. 8 is an elevation view of a coupling of the embodiment of FIG. 1.

The baseplate 58 shown in place on the foundation 37 in the section view of FIG. 5 has the present invention installed around and through it. Threaded reinforcing bars 52 pass through the holes 74. Brackets 54 attach the threaded reinforcing bars 52 to the pole 32. FIG. 6 is a section taken at a higher elevation, and shows the brackets 54 and threaded reinforcing bars 52 attached to the pole 32. An elevation view of the threaded reinforcing bar 52 mounted to the pole 32 with the brackets 54 is shown in FIG. 7.

The threaded reinforcing bar segments 52*a*, 52*b* may be joined by the use of threaded couplings 80. The threaded coupling 80 is backed on each side with a nut 82*a*, 82*b* to lock the coupling 80 into place. Such couplings 80 may be used at multiple locations and heights, as shown in FIG. 1, and both above grade and below grade. This threaded connection provides a relatively quick and easy means for joining segments of threaded reinforcing bar 52*a*, 52*b* together.

The material of the threaded reinforcing bar 52 and the coupling 80 may be hot-dipped galvanized steel, such as DYWIDAG THREADBAR® manufactured by Dycker-hoff & Widmann AG (DYWIDAG and THREADBAR are a registered trademarks of Dyckerhoff & Widmann Aktiensellschaft).

Figure 9:
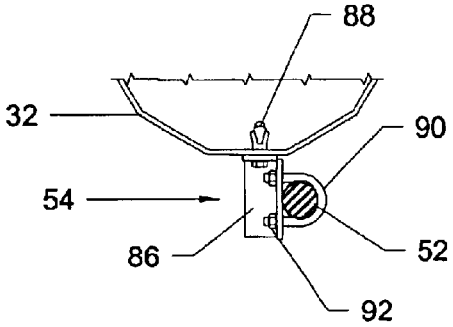
FIG. 9 is a partial plan detail view of the mounting arrangement of FIG. 7.
Figure 10:
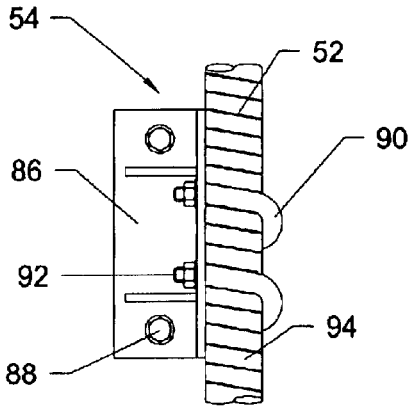
FIG. 10 is an elevation detail view of the mounting arrangement of FIG. 7.

The bracket 54 is detailed in FIGS. 9 and 10. The bracket 54 comprises a reinforcing clip angle weldment 86 with anchor bolts 88 for connecting to the pole 32 and U-shaped bolts 90 for mounting the weldment 86 to the threaded reinforcing bar 52. The U-shaped bolts 90 are fastened to the weldments 86 with nuts. The U-shaped bolts 90 are slanted such that their curved portions are lodged in, or in proximate registration with, the grooves 94 of the threaded reinforcing bar 52. This configuration prevents relative movement between the grooves 94 and the threaded reinforcing bar 52, since the threaded rod cannot slip through the U-bolt 90.

The weldment 86, anchor bolts 88, and U-shaped bolts 90 may be steel, for example, either hot-dipped galvanized or stainless steel. The anchor bolts 88 are a type that may be used to secure to structural tube when there is access to only the outside, such as the Hollo-Bolt available from Lindapter North America Inc. of Ann Arbor, Mich.

A key design factor for the threaded reinforcing bars is the moment exerted on the pole and the bars, and the resulting stresses. Relevant design standards include, among others: AISC—Allowable Stress Design Specification, $9^{th}$ Edition (American Institute of Steel Construction); ANSI/TIA/EIA-222-F Standard, Structural Standards for Steel Antenna Towers and Antenna Supporting Structures (American National Standards Institute/Telecommunications Industry Association/Electronic Industries Alliance), and ACI 318-

02, Building Code Requirements for Structural Concrete and Commentary (American Concrete Institute).

One exemplary embodiment is discussed below. This embodiment is provided to help further explain the invention, and should be understood to be illustrative and not limiting to the scope of the invention. This exemplary design is for a monopole having a height of 170 feet. The pole has 12 sides, a bottom diameter of 48 inches, and a top diameter of 16 inches. An allowable stress increase of 1.333 is used throughout the design calculations. The bracket spacing is selected to be 30 inches, with 2-½-inch diameter threaded reinforcing bar extending 90 feet high. The bars are considered to be fixed at the brackets. The design takes into consideration both compression and tension on the bars by setting tension bar force equal to compression bar force. The selected rod dimensions and bracket spacing of this design is confirmed to be acceptable by the following calculations.

Initially, the strength of the threaded reinforcing bars in compression must be computed. Considering the bracket spacing, the slenderness ratio (kl/r) of the bar is determined. This example uses 30 inches, so the length (l) is 30 inches. Despite considering the bars being fixed at the bracket connections, the k value used is 1.0 and remains so to ensure a conservative design. The radius of gyration (r) is calculated based on the given threaded reinforcing bar and varies depending on the diameter of the bar. With the slenderness ratio calculated, the allowable axial compressive stress ($F_a$) of the bar is determined. This is completed using one of the following respective equations E2-1 or E2-2 from AISC—Allowable Stress Design Specification, which are chosen based on comparison of the slenderness ratio to $C_c$. Allowable compressive stress ($F_a$) is calculated using equation E2-1 when the slenderness ratio is smaller than the $C_c$, equation E2-2 when the slenderness ratio exceeds $C_c$.

$$F_a = \frac{\left[1 - \frac{(kl/r)^2}{2C_c^2}\right]F_y}{\frac{5}{3} + \frac{3(kl/r)}{8C_c} - \frac{(kl/r)^3}{8C_c^3}}, \; kl/r < C_c \qquad \text{E2-1}$$

$$C_c = \sqrt{\frac{2\pi^2 E}{F_y}}$$

$$F_a = \frac{12\pi^2 l}{23(kl/r)^2}, \; kl/r \geq C_c \qquad \text{E2-2}$$

$F_y$ is the minimum yield strength of the bar and E is the modulus of elasticity.

The compressive bar capacity is calculated using the following equation:

$$P_{Allow} = ASI \times F_a \times A$$

where $P_{Allow}$ is the allowable axial capacity of the threaded reinforcing bar, ASI is the allowable stress increase, and A is the cross sectional area of a single bar.

With the compressive capacity of the threaded reinforcing bar determined, the moment capacity from the bars can be calculated. As stated above, both the compressive and tensile bars are assumed to have equal load in them, up to a limit being the maximum compressive capacity of the bar. Although the tensile bar will be able to resist higher loads within its cross-section, this is ignored because the additional load in the tensile bar is matched in the compressive bar. The compressive bar will exceed its allotted axial capacity, thus ensuring plastic, irreversible deformation in the compressive bar. Using the forces as a couple, a resulting moment capacity is calculated from the bars. The moment is calculated from the following equation:

$$M_{Bars} = \frac{\#_{Bars} \times P_{Allow}}{2} \times \frac{D_{Bars}}{2}$$

where $M_{Bars}$ is the moment resistance calculated from the bars, $\#_{Bars}$ is the total number of bars, and $D_{Bars}$ is the distance between the centers of diametrically opposite reinforcing bars.

The moment capacity of the monopole is checked to assess its development with respect to the full moment capacity of the threaded reinforcing bars. A ratio of $d_{Pole}/D_{Bars}$ (where $d_{pole}$ is the diameter of the pole) is calculated and is multiplied by the allowable moment capacity of the pole to ensure conservative strain compatibility design. This reduction is validated by the use of a strain ratio calculation when the strains of both the bars and the monopole at their yield strength states are considered. The ratio of the yield strain of the monopole to the buckling strain of the bar typically is greater than 0.95, meaning the monopole will be near its maximum moment capacity when the bars reach their buckling limit. However, as the diameter of the monopole decreases, this ratio becomes smaller, leading to a larger reduction in monopole strength. Thus, $d_{Pole}/D_{Bars}$ accounts for this as it becomes smaller with decreasing pole diameter. With this completed, the moment capacities of the reinforced monopole and the threaded reinforcing bars are summed to determine the system's bending resistance, as follows:

$$M_{Total} = M_{Pole} + M_{Bars}$$

where $M_{Pole}$ is the allowable bending stress of the pole times the pole's elastic section modulus times $d_{Pole}/D_{Bars}$.

Calculated shear and tension forces at the bracket/pole interface are used to determine bracket dimensions, spacing, and bolt diameters. Spacing may be reduced to prevent excessive bolt shear or increase the compressive bar capacity. For this example, the bracket is 10 inches long, 2-¾ inches deep and approximately 6 inches tall. The bolts are ⅝-inch diameter. Stiffener characteristics are determined by calculating the proposed and allowable moments on the baseplate. In this example the height and length of the stiffener is 6 inches, and the thickness is 0.625 inches.

A variety of connection means to the foundation could be used. For example, a split plate could be placed around the existing baseplate, and threaded anchor rods could be placed through the new split plate and bolted. Likewise, the threaded rods could be screwed into a welded threaded fitting mounted on a separate plate. Modifications could also be made to the existing baseplate if necessary to allow bolting off threaded rods through welded plates spaced from the foundation.

It should also be understood that not every feature of the reinforcing system described is necessary to implement the invention as claimed in any particular one of the appended claims. Various elements of reinforcing arrangements may be used to fully enable the invention. It should also be understood that throughout this disclosure, where a process or method is shown or described, the steps of the method may be performed in any order or simultaneously, unless it is clear from the context that one step depends on another being performed first.

Specific embodiments of an invention are described herein. One of ordinary skill in the structural engineering arts will recognize that the invention has other applications in other environments. In fact, many embodiments and implementations are possible. For example, the reinforcing of the present invention may be applied to other types of poles, and the securing of the reinforcing bar with the U-bolt may be used in other applications where slippage needs to be prevented. In addition, the recitation "means for" is intended to evoke a means-plus-function reading of an element in a claim, whereas, any elements that do not specifically use the recitation "means for," are not intended to be read as means-plus-function elements, even if they otherwise include the word "means." The following claims are in no way intended to limit the scope of the invention to the specific embodiments described.

What is claimed is:

1. A reinforcing apparatus for a tower monopole, the tower comprising a metal pole embedded in and extending upward from a concrete foundation, the reinforcing apparatus comprising:

a plurality of first substantially vertical reinforcing bar rod segments fixedly embedded in the foundation, adapted to be arranged approximately symmetrically around the pole, and extending upward from the foundation;

a plurality of second substantially vertical threaded reinforcing bar rod segments above and in vertical alignment with the first segments;

means for joining the vertically adjacent rod segments comprising threaded couplings; and means for attaching rod segments to the pole at vertically spaced intervals comprising a plurality of brackets mounted to the pole using anchor bolt type fasteners with U-shape bolts around the first and second rod segments and mounted to the brackets.

2. The reinforcing apparatus of claim 1 wherein the curved portions of the U-bolts are in proximate registration with the threads of the first and second threaded reinforcing bar rod segments.

3. The reinforcing apparatus of claim 1 wherein compressive and tensile bar rod segments are assumed in design to have equal loads on them at all times up to a limit that is the maximum compressive load.

4. A reinforcing apparatus for a tower monopole, the tower monopole comprising a metal pole embedded in and extending upward from a concrete foundation, the reinforcing apparatus comprising:

a plurality of first substantially vertical reinforcing bar rod segments partially and fixedly embedded in the foundation, adapted to be arranged approximately symmetrically around the pole, and extending upward from the foundation;

a plurality of second substantially vertical threaded reinforcing bar rod segments above and in vertical alignment with the first segments;

a plurality of third substantially vertical threaded reinforcing bar rod segments above and in vertical alignment with the second segments;

threaded couplings for joining the adjacent rod segments; and brackets for mounting the exposed rod to the pole at vertically spaced intervals, the brackets comprising anchor bolt type fasteners for mounting the brackets to the pole, and U-shape bolts around the exposed rods and mounted to the brackets, wherein the curved portions of the U-bolts are in proximate registration with the grooves of the threaded reinforcing bar.

5. A reinforcing apparatus for a tower monopole, the tower comprising a metal pole embedded in and extending upward from a concrete foundation, the reinforcing apparatus comprising:

a plurality of first substantially vertical base rod segments adapted to be arranged approximately symmetrically around the pole, extending upward from proximate to the foundation, and having treaded ends;

means for attaching the rod segments to the foundation; and means for mounting rod segments to the pole at vertically spaced intervals;

wherein compressive and tensile bar rod segments are assumed in design to have equal loads on them at all times up to a limit that is the maximum compressive load.

6. The reinforcing apparatus as recited in claim 5, further comprising at least one upper additional rod segment with threaded ends in vertical alignment with each base rod segment and means for joining the vertically adjacent rod segments.

7. The reinforcing apparatus as recited in claim 6, wherein the rod segments are threaded by means of a spiral groove for their full length.

8. The reinforcing apparatus as recited in claim 7, wherein the threaded rod segments comprise threaded reinforcing bar.

9. The reinforcing apparatus as recited in claim 7, wherein the means for mounting base and upper rod segments to the pole comprises a bracket mounted to the pole using anchor bolt fasteners.

10. The reinforcing apparatus as recited in claim 9, further comprising U-shaped bolts around the base and upper rod segments and mounted to the brackets.

11. The reinforcing apparatus as recited in claim 10, wherein the base and upper rod segments are threaded reinforcing bar and the curved portions of the U-bolts are in proximate registration with the grooves of the threaded reinforcing bar.

12. The reinforcing apparatus as recited in claim 5, wherein the means for attaching the base rod segments to the foundation comprises plates mounted to and spaced from the foundation, and each rod segment welded to a plate.

13. The reinforcing apparatus as recited in claim 6, wherein the means for joining the vertically adjacent rod segments comprises threaded couplings.

14. The reinforcing apparatus as recited in claim 5, wherein the means for attaching the base rod segments to the foundation comprises threaded coupling affixed to plates, each plate anchored to the foundation, and each affixed threaded coupling in vertical alignment with each base rod segment and attached to a base rod segment end.

15. The reinforcing apparatus as recited in claim 5, wherein the means for attaching the base rod segments to the foundation comprises plates mounted to and spaced from the foundation, each base rod segment passing through a plate and fixed in position with a nut threaded onto the base rod segment on the underside of the plate.

16. The reinforcing apparatus as recited in claim 5, further comprising vertical rod segments partially embedded in the foundation, with threaded ends extending upward out of the foundation and in vertical alignment with the base rod segments, wherein means for attaching base rod segments to the foundation comprises threaded couplings that join the partially embedded rod segments to the base rod segments.

17. The reinforcing apparatus as recited in claim 16, further comprising at least one fully embedded rod segment below and vertically aligned with each partially embedded rod segment, and means for joining each fully embedded rod segment to a respective partially embedded rod segment.

18. The reinforcing apparatus as recited in claim 17, wherein the means for joining comprises a threaded coupling.

19. A reinforcing apparatus for a tower monopole, the tower monopole comprising a metal pole embedded in and extending upward from a concrete foundation, the reinforcing apparatus comprising:

a plurality of first substantially vertical threaded reinforcing bar rod segments, embedded in the concrete foundation, extending upward from the foundation, and adapted to be arranged approximately symmetrically around the pole; and brackets for mounting the exposed rod to the pole at vertically spaced intervals, the brackets comprising anchor bolt type fasteners for mounting the brackets to the pole, and U-shape bolts around the exposed rods and mounted to the brackets, wherein the curved portions of the U-bolts are in proximate registration with the threads of the threaded reinforcing bar.

20. The reinforcing apparatus as recited in claim 19 further comprising:

A plurality of second substantially vertical threaded reinforcing bar rod segments above and in vertical alignment with the first segment; and threaded coupling for joining the vertically adjacent rod segments.

21. A method for reinforcing a tower monopole, the tower monopole comprising a metal pole embedded in and extending upward from a concrete foundation, the steps comprising:

coring at least three holes in the foundation approximately symmetrically spaced around the pole, the holes having a depth and dimension to each accept a portion of a first threaded reinforcing bar rod segment;

installing a plurality of mounting devices on the portion of each first rod segment that will be exposed after being place in the cored hole;

placing each first rod segment into each respective cored hole, leaving a portion of the first rod segment partially exposed above the foundation's surface;

grouting the void around each first rod segment in each respective cored hole;

installing a plurality of mounting devices on a plurality of second threaded reinforcing bar rod segments;

joining a second rod segment, extending upward vertically, to each of the exposed ends of the first rod segments, using a threaded coupling;

drilling holes in the pole adapted to receive the mounting devices; and attaching the mounting devices to the pole.

22. The method for reinforcing a tower monopole as recited in claim 21, wherein the mounting devices comprises a welded bracket, anchor bolts for mounting the bracket to the pole, and U-shaped bolts mounted to the bracket, the U-shaped bolts in proximate registration with the grooves in the threads of the threaded reinforcement bar.

23. The method for reinforcing a tower as recited in claim 21, further comprising the step of designing the bar rod segments based on the assumption that compressive and tensile loads have equal loads on them at all times up to a limit that is the maximum compressive load.

* * * * *